United States Patent [19]

Holte et al.

[11] Patent Number: 4,704,036

[45] Date of Patent: Nov. 3, 1987

[54] PULSE MEASUREMENT CIRCUIT

[75] Inventors: Timothy M. Holte, Beaverton; Lee J. Jalovec, Portland, both of Oreg.

[73] Assignee: Tektronix, Inc., Beaverton, Oreg.

[21] Appl. No.: 877,080

[22] Filed: Jun. 23, 1986

[51] Int. Cl.[4] ..... G04F 8/00

[52] U.S. Cl. ..... 368/120

[58] Field of Search ..... 368/113–120; 315/392, 391, 393; 377/20; 364/569

[56] References Cited

U.S. PATENT DOCUMENTS

| | | | |
|---|---|---|---|
| 2,665,410 | 1/1954 | Burbeck | 368/119 |
| 3,249,867 | 5/1966 | Hattersley et al. | 368/120 |
| 3,376,504 | 4/1968 | Chick | 368/118 |
| 3,564,399 | 2/1971 | Laukien | 368/118 |
| 3,975,684 | 8/1976 | Mordan | 368/117 |
| 4,109,182 | 8/1978 | Dalton | 368/117 |
| 4,223,267 | 9/1980 | Sartorius et al. | 368/118 |
| 4,350,953 | 9/1982 | Best et al. | 368/115 |
| 4,551,656 | 11/1986 | Metz | 315/392 |
| 4,637,733 | 1/1987 | Charles et al. | 368/120 |

*Primary Examiner*—Vit W. Miska

*Attorney, Agent, or Firm*—Mark L. Becker; George T. Noe

[57] ABSTRACT

A pulse measurement circuit for measuring timing parameters includes main and delayed trigger generators and a timer for measuring the time between generation of the two trigger signals. The circuit further includes an adjustable delay circuit that senses the main trigger signal and in response enables the delayed trigger generator for triggering after a selectable delay. To measure a timing parameter of a pulse, both trigger generators are first caused to trigger on the first parameter boundary and the time between generation of the two trigger signals is measured. The delayed trigger generator is then caused to trigger on the second parameter boundary while the main trigger generator again triggers on the first parameter boundary. The time difference between generation of the two trigger signals is again measured. The first time is subtracted from the second time to measure the time of the pulse parameter.

15 Claims, 4 Drawing Figures

PULSE MEASUREMENT CIRCUIT

FIELD OF THE INVENTION

This invention relates generally to pulse measurement circuits and in particular to such a circuit within a dual time-base oscilloscope for accurately measuring timing parameters of a triggering pulse such as the width, period, and transition time.

BACKGROUND OF THE INVENTION

Conventional dual time-base oscilloscopes such as disclosed in U.S. Pat. Nos. 4,551,656 to Metz and U.S. Pat. No. 4,109,182 to Dalton have two sweep or ramp generators for generating a main sweep and a delayed sweep. The starting point for the delayed sweep may be selected at any time point along the main sweep. This delayed starting point enables the delayed sweep to expand the selected main sweep segment for visual measurement of a pulse or other event of interest within the segment using the lined graticule on the oscilloscope cathode ray tube (CRT). For example, to measure the timing parameters of a pulse, such as its period, the delayed sweep can be set to display the pulse in expanded form for higher resolution on the graticule. The drawback of this measurement technique, of course, is the error inherent in visually calculating values from a graticule. This is particularly true when the widths of the electron beam and the graticule lines are large relative to the resolution desired.

SUMMARY OF THE INVENTION

An object of the invention, therefore, is to provide an improved method for measuring the timing parameters of a signal pulse.

Another object of the invention is to calculate electronically these parameters and display the calculations to an instrument operator.

Yet another object of the invention is to provide such a measurement method within a dual time-base oscilloscope.

Still another object of the invention is to enable the main and delayed trigger generators on an oscilloscope to trigger on the same event.

To achieve these objects, a pulse measurement circuit includes a main trigger means and a delayed trigger means. A first delay means senses generation of the main trigger signal and in response enables the second trigger means for triggering after a selectable delay. Passage of the pulse to the delayed trigger means is delayed for a predetermined time by a second delay means. A measurement means then measures the time between the main and delayed trigger signals. By adjusting the delay of the first delay means, the delayed trigger means can be caused to trigger on the same pulse as the main trigger means or on a successive pulse.

To measure a timing parameter of a pulse, the main and delayed trigger generators are caused to trigger on the same pulse at a first parameter boundary, such as a predetermined voltage level and slope. A first time between generation of the two trigger signals is then measured. One of the trigger generators is then caused to trigger at a second parameter boundary, such as another voltage level and slope. A second time between generation of the two triggering signals is then measured. The first time measurement is then subtracted from the second time measurement to measure the time of the pulse parameter.

The foregoing and other objects, features, and advantages of the invention will become more apparent from the following detailed description of a preferred embodiment which proceeds with reference to the accompanying drawings.

DETAILED DESCRIPTION

Figure 1:
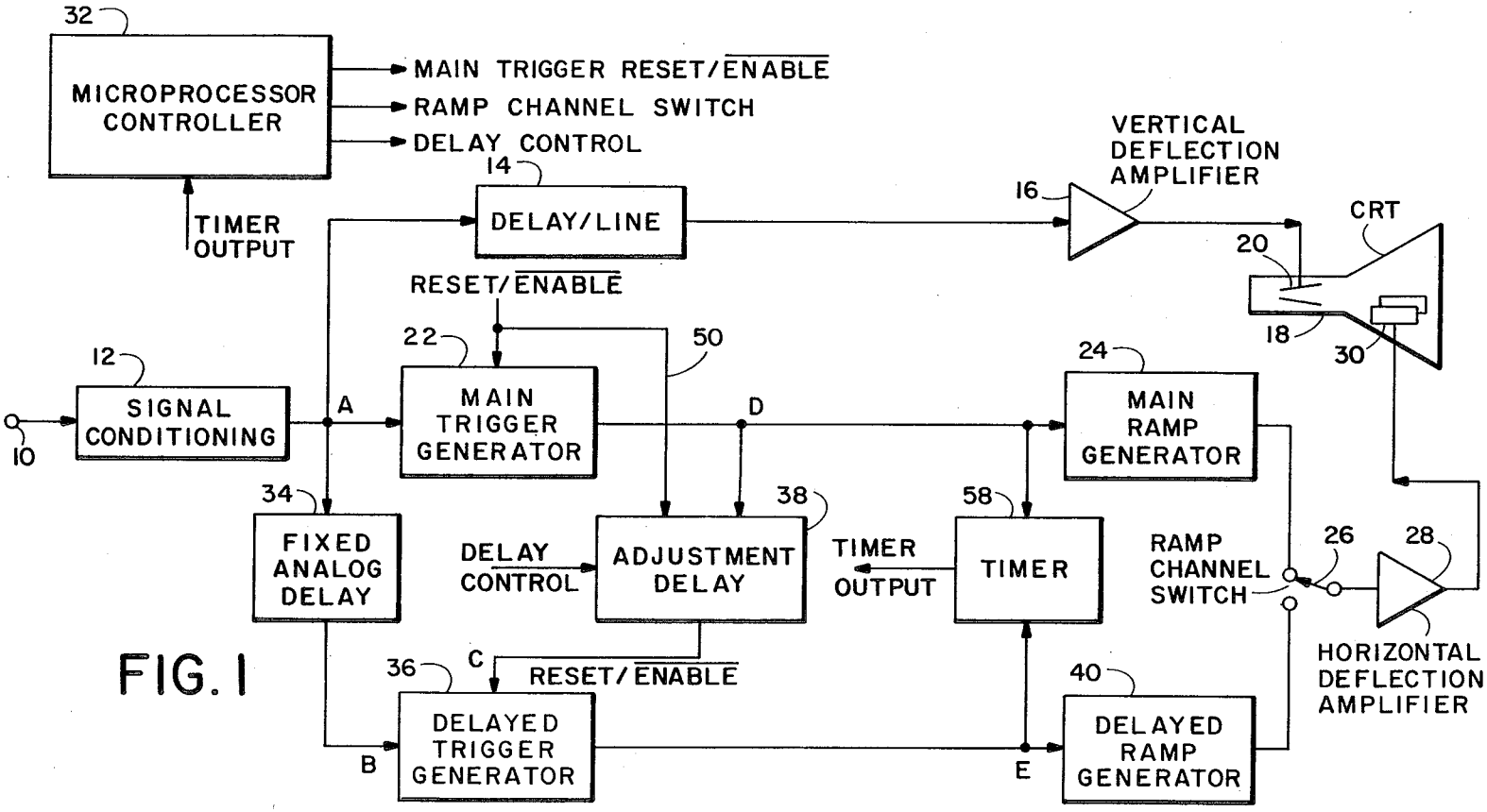
FIG. 1 is a block diagram of a dual time-base oscilloscope including a pulse measurement circuit according to the invention.

Referring to FIG. 1, a block diagram of a dual time-base oscilloscope embodying a pulse measurement circuit according to the invention is shown. The pulse measurement circuit herein described could be used in a number of different measuring instruments and is shown in the context of an oscilloscope for example only.

One of a possible plurality of vertical channels, which is conventional, is shown. The channel comprises an input terminal 10 for receiving an electrical input signal, signal conditioning circuitry 12 for attenuating the signal, a delay line 14 for delaying the signal to coincide with a horizontal sweep signal, a vertical deflector amplifier 16, and a cathode ray tube (CRT) 18. The CRT 18 includes a pair of vertical deflection plates 20 that respond to the input signal to deflect an internal electron beam (not shown) across the screen of the CRT to reproduce a waveform in a conventional manner.

The sweep or ramp generating circuits of the oscilloscope may be triggered from internal, power line, or external signal sources. For purposes of describing this invention, internal triggering of the input signal is assumed so that a time relationship can be established between the triggering of the main and delay trigger generators. At point A in the diagram of FIG. 1, the input signal that is routed through the vertical channel is picked off as the internal triggering signal and applied to a main trigger generator 22. The generator 22 is of a conventional design that includes a voltage level comparator and a signal slope selector. At a selectable triggering point, such as a specific pulse slope and voltage level, the trigger generator 22 generates a trigger signal in response to the pulse. The trigger signal is applied to a main sweep or ramp generator 24. The ramp generator 24 can be a Miller integrator or a constant current source in series with a capacitor to produce a ramp voltage. The ramp voltage is routed through a ramp channel switch 26 and a horizontal deflection amplifier 28 to horizontal deflection plates 30 of the CRT 18. Once the trigger signal has been generated, trigger generator 22 is reset and then enabled in a conventional manner by a main trigger control signal from a microprocessor controller 32.

The input signal is also applied as an internal triggering signal at point A through a fixed analog delay 34 such as a coaxial cable to a delayed trigger generator 36 at a point B. The delayed trigger generator 36 is adjustable, as is the main trigger generator 22, to trigger at selectable slope and voltage levels of the input signal. A reset/enable signal is provided at a point C for the delayed trigger generator 36 by an adjustable delay 38. The reset/enable signal is generated by the adjustable delay 38 in response to the main trigger signal at a point D to enable the delayed trigger generator after a selectable delay. The delayed trigger signal, once generated by the enabled generator 36, is routed to a delayed sweep or ramp generator 40. The generator 40 in turn produces a ramp voltage that is applied through the channel switch 26 and horizontal deflection amplifiers 28 to the horizontal deflection plates 30 of the CRT 18. As is commonly found in dual time-base oscilloscopes, the switch 26 is used to alternate or chop the sweep voltages of the main ramp generator 24 and the delayed ramp generator 40 to display the input signal waveform on both sweeps simultaneously.

Figure 2:
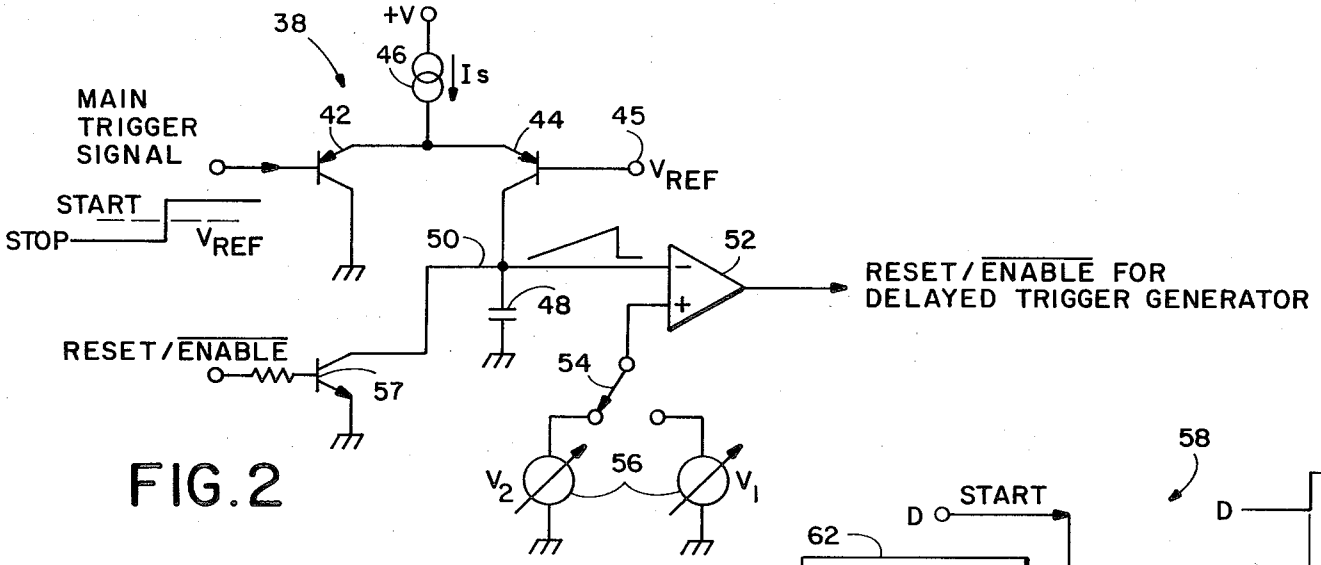
FIG. 2 is a schematic diagram of delay circuit within the pulse measurement circuit of FIG. 1.

Referring to FIG. 2, a schematic diagram of the adjustable delay 38 is shown. While the delay 38 may take many forms, a simple embodiment thereof comprises a differential amplifier having a pair of transistors 42, 44, with the main trigger signal as the differential input to transistor 42 and a constant voltage from a reference voltage source 45 as the differential input to transistor 44. A current source 46 provides current to the transistor of the transistor pair 42, 44 with the lower input voltage. Connected to the collector of transistor 44 are a capacitor 48, a reset/enable line 50 from the microprocessor controller 32, and the inverting input of a comparator 52 that generates the enable signal to the trigger generator 36. Connected to the noninverting input of the comparator 52 via a switch 54 is one of a possible plurality of reference voltage sources 56. The switch 54 and voltage level of the sources 56 form an adjustable delay control for the delay 38.

When the main trigger signal is generated at trigger generator 22, the signal voltage rises to exceed the voltage of the reference voltage source 45, causing the current from the current source 46 to switch from transistor 42 to transistor 44. With the impedance on line 50 high in the enable mode, the current through transistor 44 charges capacitor 48 linearly to produce a ramp voltage applied to the inverting input of comparator 52. This ramp voltage is compared against the voltage level from one of the reference voltage sources 56 controlled by the controller 32 to produce the reset/enable signal to the delayed trigger generator 36 at point C. The controller 32 thus controls the signal propagation delay through the delay 38. The adjustable delay 38 is reset by a reset signal from controller 32 that causes a transistor 57 to saturate, which allows the capacitor 48 to discharge through line 50.

The electrical duration of the fixed analog delay 34 is chosen to be at least as long as the sum of the signal propagation delays through the main trigger generator 22 and the adjustable delay 38 adjusted to its minimum delay. By delaying the input signal to the delayed trigger generator 36, the delay 34 allows the generator 36 to be enabled by the delay 38 before the arrival of a triggering pulse so that both trigger generators can trigger on the same pulse. Alternatively, the delay trigger generator 36 can be controlled via its reset/enable line from the adjustable delay 38 to trigger on a successive pulse by increasing the propagation delay through the adjustable delay. With a sufficient delay added to delay 38, the delayed trigger generator 36 will not be enabled when the triggering pulse arrives at point B. The generator 36 will, however, be enabled to trigger on a successive pulse of a repetitive signal.

Figure 3:
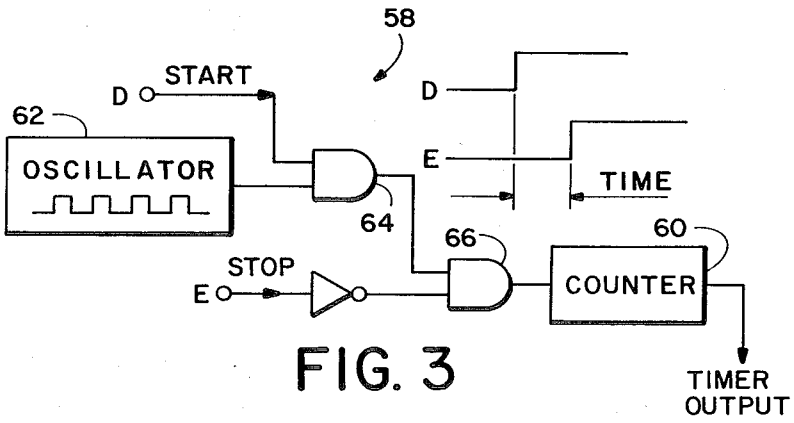
FIG. 3 is a schematic diagram of a timing circuit within the pulse measurement circuit of FIG. 1.

Although both trigger generators can trigger on the same pulse, they do not trigger simultaneously since the pulse the main trigger generator 22 must trigger before the delayed trigger generator 36 is enabled. The time differential between generation of the main trigger signal and generation of the delayed trigger signal is measured by a timer 58 (FIG. 3) that routes its data output to the microprocessor controller 32. Referring to FIGS. 1 and 3, timer 58 comprises a counter 60 that counts the pulses of an oscillator 62 such as a crystal whose pulses are counted between the appearance of the main trigger signal at a point D and the appearance of the delayed trigger signal at a point E. The appearance of the main trigger signal provides a signal input to counter 60 by enabling AND gate 64. The oscillating signal is then routed through gate 64 and a second AND gate 66 that is enabled by the absence of the delayed trigger signal. When the delayed trigger signal does appear, it disables the AND gate 66, stopping the counter 60. The count, of course, corresponds to the time measurement between generation of the two trigger signals. The controller 32 then records the count received during the two trigger signals.

The differential time is measured twice, once for the time between main and delayed trigger signals generated by the first parameter boundary of a timing parameter and once for the time between generation of the main trigger signal on the first parameter boundary and generation of the delayed trigger signal on the second parameter boundary. These boundaries are predetermined triggering points comprising a selected pulse slope and voltage level. For example, the parameter boundaries for the pulse width parameter may be a positive slope at 50% of the maximum voltage level and a negative slope at 50% of the maximum voltage level. The first time measurement is then subtracted from the second time measurement by controller 32 to remove the time difference due solely to triggering both generators on the same parameter boundary. The remaining time is the actual time between two parameter boundaries. This time is then displayed or otherwise indicated to an operator by the controller 32.

It should be emphasized that the delayed trigger generator 36 must be enabled before the input signal pulse enters the hysteresis region of the generator. If the enabling signal at point C appears after the pulse enters the hysteresis region, the generator 36 will not trigger until the voltage level of the pulse drops below the hysteresis region and then again rises to enter it and exceed the trigger threshold of the generator. This, of course, would most likely occur on a successive pulse.

The pulse measurement circuit described herein allows accurate differential measurements to be made of common pulse timing parameters of a repetitive signal such as period, width and transition time. The method requires two sets of pulses and is illustrated in the timing diagram of FIG. 4 for measuring the period parameter of a pulse. The input signal at point A is a repetitive signal that causes the main trigger generator 22 to generate a main trigger signal at point D after a delay through the generator. On the left portion of FIG. 4, the delay 38 is set at a minimum and enables the delayed trigger generator 36 after a further delay. Meanwhile, the input signal is delayed through the fixed analog delay 34 to arrive at point B after the delayed trigger generator 36 is enabled. Both generators 22 and 36 therefore trigger on the first parameter boundary, i.e., at the same voltage level on the same slope of the same pulse, but at different times. This first time measurement between generation of the two triggering signal is then calculated by the timer 58 and controller 32.

In actual practice, it is preferable that the main trigger generator 22 trigger at a lower voltage level than the delayed trigger generator 36 for a positive slope trigger or at a higher voltage level for a negative slope trigger. This improves the likelihood that the enabling signal at point C will arrive before the input signal enters the hysteresis region of the delayed trigger generator 36.

Figure 4:
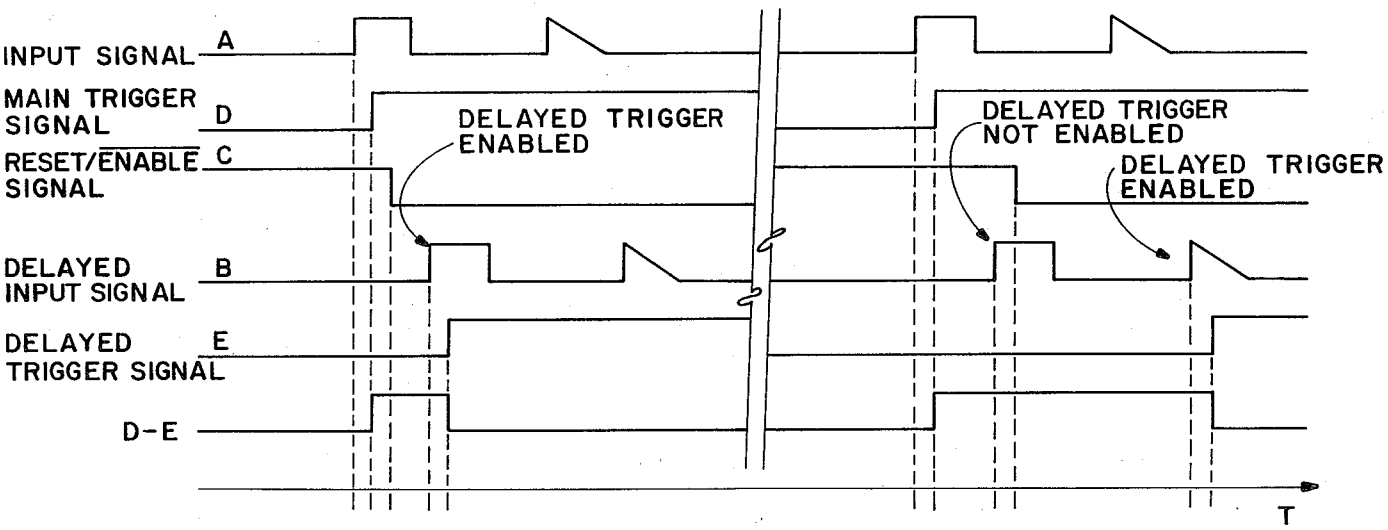
FIG. 4 is a timing diagram showing the relationship between signals within the pulse measurement circuit of FIG. 1.

The right portion of FIG. 4 illustrates the case after the delay 38 has been adjusted to delay enabling of the delayed trigger generator 36 so that it will trigger on the second parameter boundary, here the same voltage and slope as before but on a successive pulse. In this case, the total delay through the main trigger generator 22 and delay 38 exceeds the delay through the fixed analog delay 34. The second set of pulses is then received by the generators 22 and 36. The main trigger generator 22 again triggers on the first parameter boundary, but the delayed trigger generator triggers on the second parameter boundary. The timer 58 measures a second time between generation of the two trigger signals. (Generator 22, of course, is not reset until generator 36 triggers so that generator 22 does not trigger on the successive pulse.) Subtraction of the first time measurement from the second time measurement yields the actual time of the pulse period.

For measuring pulse width, the generators 22 and 36 are adjusted to cause them both to first trigger at the first parameter boundary, a voltage level that corresponds to the beginning of the pulse and on the same slope, for example the positive slope. The time between generation of the two trigger signals is calculated and stored by the controller 32 via the timer 58. The delayed trigger generator 36 is then adjusted to trigger at the second parameter boundary, which has the same voltage level as before but a slope of opposite polarity. The second set of pulses is then received by the generators 22 and 36. The main trigger generator again triggers on the positive slope of a pulse, but the delayed trigger generator triggers on the negative slope of the same pulse. Again the time is calculated and stored, and the controller 32 subtracts the first time measurement from the second time measurement to measure the time of the pulse width.

The transition or rise time is calculated similarly to the pulse width. Both trigger generators 22 and 36 are adjusted to cause them to trigger on the first parameter boundary, the positive slope of the same pulse at a low voltage level indicative of the beginning of the pulse, typically 10% of its amplitude. After the controller 32 has calculated and stored the first time measurement, the generator 36 is adjusted to trigger on the same slope but at a higher voltage level such as 90% of the pulse amplitude. The second set of pulses is then received by the generators 22 and 36. The main trigger generator 22 again triggers at the low voltage level, but the delayed trigger generator 36 triggers at the higher voltage level on the same slope and pulse. The controller 32 subtracts the first time measurement from the second time measurement to measure the rise time of the pulse.

Having illustrated and described the principles of the invention in a preferred embodiment, it should be apparent to those skilled in the art that the invention can be modified in arrangement and detail without departing from such principles. For example, the pulse measurement circuit described could be utilized in any type of measuring circuit and is not limited to an oscilloscope. We claim all modifications coming within the spirit and scope of the following claims.

We claim:

1. In a measuring instrument, a pulse measurement circuit for measuring a timing parameter of a pulse on an input signal, comprising:

means for generating a first trigger signal in response to the pulse;

means for generating a second trigger signal in response to the pulse;

first delay means for sensing the first trigger signal and in response enabling the second trigger means for triggering after a selectable delay;

second delay means for delaying passage of the pulse to the second trigger means until after the pulse has passed to the first trigger means, said second delay means allowing the second trigger means to be enabled by the first delay means and trigger on the same pulse as the first trigger means; and measurement means for measuring the time between generation of the first and second trigger signals to determine the time of a pulse parameter.

2. The circuit of claim 1 in which the first delay means is adjustable for enabling the second trigger means to trigger on the same pulse as the first trigger means or for enabing the second trigger means to trigger separately on a successive pulse.

3. The pulse measurement circuit of claim 1 in which the first and second trigger meeans are adjustable for enabling the trigger means to trigger at selectable slopes and levels of a pulse, the measurement means thereby capable of measuring the width, transition time, and period parameters of the pulse.

4. The pulse measurement circuit of claim 1 in whch the first delay means comprises an adjustable delay circuit and the second delay means comprises a fixed analog delay circuit.

5. The pulse measurement circuit of claim 1 in which the first delay means comprises:

a differential amplifier having the main trigger signal and a first reference voltage as differential inputs and a ramp voltage as an output; and a comparator having the ramp voltage of the differential amplifier and an adjustable second reference voltage as inputs and an enabling signal to the second trigger means as an output, the comparator generating the enabling signal when the ramp voltage crosses the level of the second reference voltage.

6. The pulse measurement circuit of claim 5 including a plurality of second reference voltages and a means for selecting among the reference voltages.

7. The pulse measurement circuit of claim 1 in which the measurement means comprises an oscillator and a counter, the oscillator providing a count as input to the counter, the oscillator count enabled by the first trigger signal and disabled by the second trigger signal.

8. The pulse measurement circuit of claim 1 in which the measuring intrument is an oscilloscope.

9. In a measuring instrument, a pulse measurement circuit for measuring a timing parameter of a pulse on an input signal, comprising:

a main trigger generator for generating a main trigger signal in response to a parameter boundary of the pulse;

a delayed trigger generator for generating a delayed trigger signal in response to a parameter boundary of the pulse;

first adjustable delay means for sensing the main trigger signal and in response enabling the delayed trigger generator to trigger after a selectable delay;

second delay means for delaying passage of the pulse to the delayed trigger generator until after the pulse has passed to the main trigger generator, the second delay means allowing the delayed trigger generator to be enabled by the first delay means and trigger on the same pulse as the main trigger generator for a predetermined delay;

measurement means for measuring a first time between the main and delayed trigger signals when both are adjusted to trigger on the same pulse at a first parameter boundary and for measuring a second time between trigger signals when one generator is adjusted to trigger on the first boundary and the other generator is adjusted to trigger on a second parameter boundary; and controller means for subtracting the first time measurement from the second time measurement to measure the time of the pulse parameter.

10. A method of measuring a timing parameter of an input signal pulse to a measuring instrument, the instrument having a main trigger generator and a delayed trigger generator, comprising:

causing the main and delayed trigger generators to trigger on the same pulse at a first parameter boundary;

measuring a first time between generation of the trigger signals;

causing one of the generators to trigger at a second parameter boundary while the other again triggers on the first parameter boundary;

measuring a second time between generation of the trigger signals; and subtracting the first time measurement from the second time measurement to measure the time of the pulse parameter.

11. The method of claim 10 in which the first parameter boundary is a pulse slope and the main trigger generator is caused to trigger on the slope at a voltage level equal to or less than the trigger voltage level of the delayed trigger generator.

12. The method of claim 10 in which the parameter measured is the pulse period and causing one of the generators to trigger on the second parameter boundary comprises delaying triggering of the generator until the arrival of a successive pulse.

13. The method of claim 10 in which the parameter measured is the pulse width and causing one of the generators to trigger on the second parameter boundary comprises adjusting the generator to trigger on a pulse slope of polarity opposite the pulse slope of the first parameter boundary.

14. The method of claim 10 in which the parameter measured is the pulse transition time and causing one of the generators to trigger on the second parameter boundary comprises adjusting the generator to trigger at a voltage level different from the voltage level of the first parameter boundary.

15. The pulse measurement circuit of claim 2 in which the delay of the second delay means is greater than the signal propagation through the first trigger means and first delay means when adjusted for minimum delay.

* * * * *